United States Patent [19]

Jurgens

[11] 4,205,757

[45] Jun. 3, 1980

[54] CAN OPENING AND LIQUID DISPENSING MEANS

[76] Inventor: Thomas R. Jurgens, 11772 Grant Dr., Yucaipa, Calif. 92399

[21] Appl. No.: 925,281

[22] Filed: Jul. 17, 1978

[51] Int. Cl.[2] ..... B67B 7/26

[52] U.S. Cl. ..... 222/83; 222/85

[58] Field of Search ..... 222/83, 83.5, 85, 86, 222/88, 89, 91

[56] References Cited

U.S. PATENT DOCUMENTS

| | | | |
|---|---|---|---|
| 2,105,575 | 1/1938 | Wiswell | 222/83 |
| 2,607,511 | 8/1952 | Uljak | 222/83 |
| 3,014,621 | 12/1961 | Pouitz | 222/88 X |

*Primary Examiner*—Stanley H. Tollberg
*Attorney, Agent, or Firm*—John H. Crowe

[57] ABSTRACT

A can opening device with a built-in pouring spout that can be affixed to a can of engine oil for use in transferring oil from the can and is equipped with a punch that can be manually operated to open an air vent in the wall of the can. The device has a cutter of conventional type for cutting a pour hole in the top of the can, a conventional guide of the sort that rides against the side of the can to guide the cutter in its cutting operation, and a pouring spout shaped to serve as a handle for use in forcing the cutter through the can top. The punch is pivotally mounted on a metallic arm that is secured to the pouring spout, which arm is bent to extend diametrically across the top of a can to which the device is attached, from the pour hole formed by the cutter, then down the opposite side of the can to a point near its bottom end. The punch has a pointed claw at its forward end and is formed with a handle by means of which the claw can be swung into piercing contact with the wall of the can to form the above-mentioned air vent. The resulting air vent is in that part of the wall farthest removed from the pour hole in the top of the can.

9 Claims, 4 Drawing Figures

CAN OPENING AND LIQUID DISPENSING MEANS

BACKGROUND OF THE INVENTION

This invention relates generally to can opening and liquid pouring means for use in the dispensing of liquids from sealed cans, and more particularly to such means primarily suitable for use in the rapid dispensing of engine oil from sealed cans, with minimal risk of spillage.

For many years, engine oil has been sold in quart-sized cans from which it can be poured directly into the oil filler openings of automobile, truck etc., engines. During this period, various types of can opening and dispensing devices have been proposed for use in the transfer of oil from these cans into such filler openings, some of which have included means for venting the cans to facilitate the outflow of oil therefrom. All such devices of which I am aware, however, have been designed to form vent holes improperly positioned for most effective performance and, in some cases, so poorly positioned as to present serious oil leakage problems. In this connection, U.S. Pat. No. 2,812,112 to Allen discloses a can opener and dispenser comprising a bar designed to fit diametrically across the top of a can fitted with a pouring spout at one end and a punch for venting the top of the can at the other end. The position of the vent hole made by the Allen device in the top of the can detracts from its effectiveness because it allows oil to block the hole and leak therethrough when the can is tilted to permit the pouring of its contents through said pouring spout. U.S. Pat. No. 3,134,506 to Way discloses another device attachable to an oil can to provide pouring and air vent openings in the top of the can. This device is subject to the same objection insofar as the position of the air vent opening is concerned as the Allen device. U.S. Pat. No. 2,547,556 to Benigar discloses a puncturing and dispensing device for oil cans adapted to punch an opening in one end of such a can through which the oil can be dispensed, and cut a second (air vent) opening in the opposite end of the can in line with the dispensing opening. The problem here is that when the can is tilted for the pouring of oil into the oil filler of an automobile engine, or the like, the oil level in the can is higher than the air vent opening, to again pose a problem of oil leakage. Each of U.S. Pat. Nos. 1,293,244 to Thayer et al. and 2,061,582 to Luthi discloses a liquid dispenser adapted to form pouring and vent openings in the same end of a can, hence is subject to the above-discussed oil leakage shortcoming of the Allen device. U.S. Pat. Nos. 2,099,323 and 2,105,575, both to Wiswell, teach can opening and dispensing devices with punch attachments for punching vent holes in the ends of oil cans. In each case, oil dispensing and air vent holes are of necessity formed in the same end of the oil can on which the device is used, so that the device is subject to the same criticism as the Allen device, and others of similar character, discussed above, insofar as oil leakage propensity of the air vent hole is concerned.

In addition to being poorly positioned for most effective transfer of oil from cans with minimal risk of leakage, the vent holes provided by the devices of the above-mentioned patents are all, because of the manner of operation of those devices, formed during the attachment of the devices to oil cans, and prior to the time any oil is poured from the cans. This, it seems to Applicant, is poor timing insofar as the venting of the can is concerned since it gives the user of any such device no opportunity to select the most opportune time for venting an oil can to gain maximum flow rate, with minimum risk of oil leakage, from the can.

There is thus, in view of the foregoing, a need for can opening and liquid dispensing means with cooperating means under the control of the user to give him the opportunity of venting a can at the optimum position and time to achieve the fastest outflow of oil therefrom with little or no risk of oil leakage at the vent hole. Such venting means under the control of the user should ideally permit him to form an air vent hole above the oil level in the can after only a small amount of the oil has been dispensed to insure emptying of the can in the shortest period of time. This need for a can opening and oil dispensing device with air venting means for optimum effect position-wise and time-wise has never been satisfied, or even recognized, insofar as I am aware.

In spite of the fact that oil can opening and liquid dispensing devices with air vent puncturing means have been known for some time, as evidenced by the above-referenced patents, no such device has ever been, to my knowledge, in widespread usage, possibly because of the above-discussed oil leakage disadvantages thereof. Motor oil is generally dispensed from cans by means of attachable oil can spouts that cut pouring openings in the cans but do not form air vent holes therein. As a result, the oil cans drain annoyingly slow, forcing the users of such oil can spouts to stand impatiently by, or find other things to do, until the cans are empty. Means for providing a properly positioned air vent in the can, at such time as risk of oil leakage through the vent is passed, would greatly speed up the process of adding motor oil to a car engine and allow such oil addition to be accomplished without interruption or an aggravating wait for the sluggish draining of oil from one or more cans.

SUMMARY OF THE INVENTION

I have now, by this invention, provided a novel can opening and liquid dispensing device by means of which motor oil can be rapidly drained from cans without the oil leakage problems incident to use of the prior art devices discussed above. When my new device is employed, the oil drains quickly from a can almost from the time the can is tilted for pouring, this being made possible by unique venting means adapted to provide an air vent hole in the can at such time and place as to avoid oil leakage therethrough while insuring rapid outflow of substantially all of the contents of said can. The air vent hole can be formed at the beginning of the pouring procedure, or so shortly thereafter that there is practically no delay because of the slow trickle of oil from the unvented can, such as that which occurs throughout the pouring procedure when a conventional oil can spout of the type referred to above is employed. Thus, when my new device is used, the oil gushes from the can virtually from the time it is positioned for pouring at so fast a rate that the empty can can be removed in a mere fraction of the time required to drain an unvented can. This rapid-flow feature of my novel can opening and liquid dispensing device is of great time saving advantage, particularly to service station, garage, and other employees who are called upon to service the oil needs of many vehicles, to say nothing of its therapeutic value in eliminating the petty annoyance of being forced to put up with the slow trickle of oil from unvented cans.

Although my novel can opening and liquid dispensing device is similar to the conventional prior art oil can spout described above in certain respects, it differs from the latter in having an accessory, manually operable punch mounted on an arm attached to the main body of the device in such position as to provide an air vent puncture in the side wall of an oil can near the highest point in the can wall when the can has been opened for use and positioned for pouring as taught herein. The punch remains inoperative until such time as needed by the user, at which time it can be easily manipulated by the fingers to pierce the can wall and form an air vent opening therein. Since it will be punched in the can wall near the highest part of the can, there is little risk of oil leakage in forming this opening almost as soon as the can is positioned for pouring because from that instant on oil is draining from the can to lower the oil level therewithin below the highest part of the can interior. As soon as the air vent opening is formed, atmospheric pressure entering the can through that opening causes the flow of oil from the can to be greatly accelerated. As will be seen, the punch is so designed that anyone, regardless of his or her size or strength can use it with ease.

It is a principal object of this invention to provide simple, inexpensive, easily operable means for the dispensing of motor oil from cans with great speed and dispatch and substantially no risk of oil spillage.

Other objects, features and advantages of the invention will become apparent to those skilled in the art in the light of subsequent teaching herein.

DESCRIPTION OF PREFERRED EMBODIMENT

Figure 1:
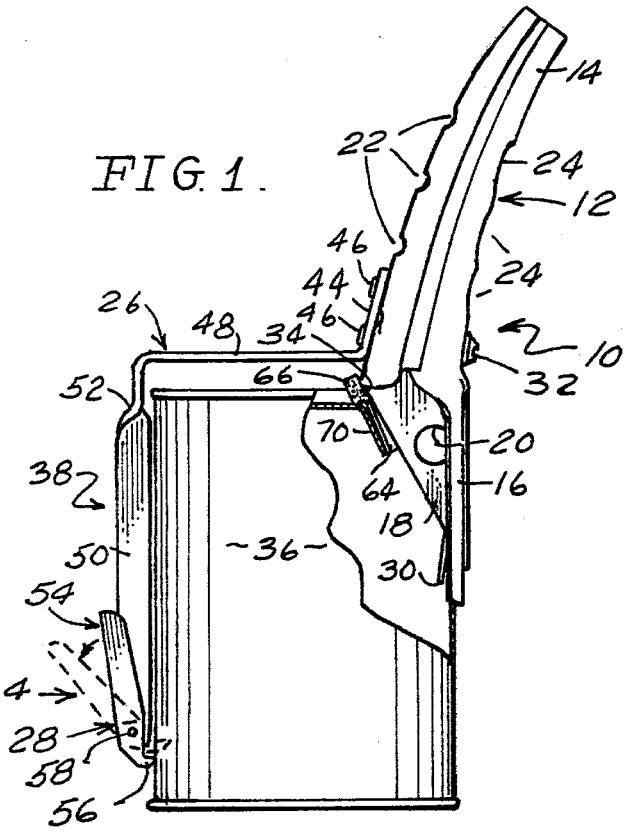
FIG. 1 is a side elevation of a preferred embodiment of a can opening and liquid dispensing device in accordance with this invention attached to an oil can for use, the can being shown partially broken away to reveal the manner of attachment of the device thereto and a manually operable punch forming a part of said device being shown in two positions in solid and phantom lines, respectively, to illustrate its manner of use.

In the drawing, the preferred embodiment of the can opening and liquid dispensing device of this invention is shown generally at 10. This device is designed primarily for use on quart-sized cans of motor oil as means whereby the oil can be quickly and easily transferred from the cans into automobile crankcases or the like. The device has a main body portion 12 to which is attached a side arm 26 carrying a pivotally connected punch member 28 at its outer end. The main body portion 12 is of metallic construction and has a first part 14 forming a handle and spout and a second part, integral with the first, forming a guide 16. Additionally, the device 10 has an elongate, metallic cutter 18 of generally U-shaped cross-section for most of its length and terminating in a point 30. The handle and spout part 14 of the main body portion 12 has a hollow interior and is of curved configuration, as seen in FIG. 1, which permits convenient grasping of the device 10 for insertion of the cutter 18 into the top of a suitably sized can to cut an opening therein in the below-described manner.

Figure 2:
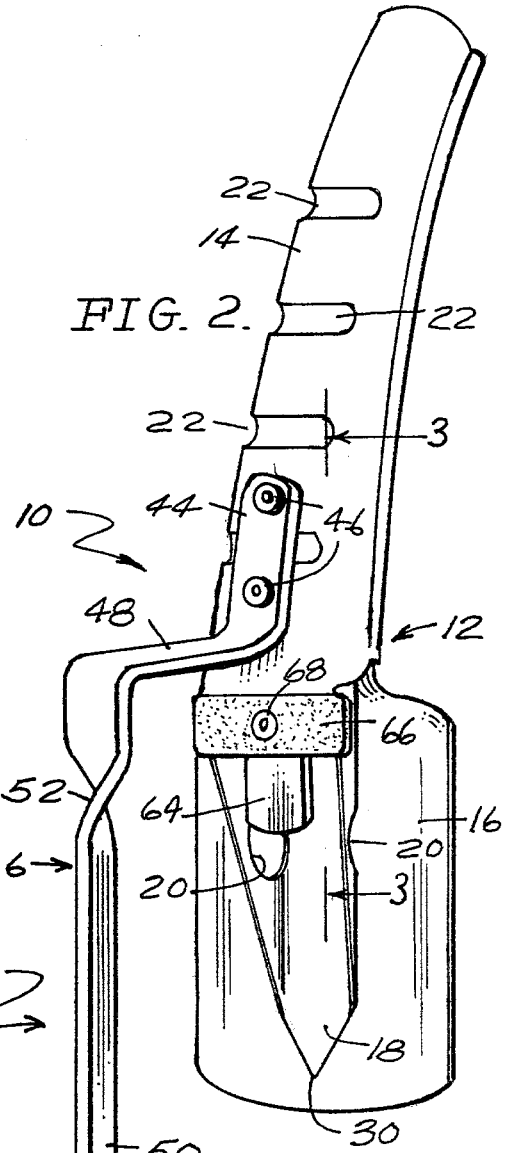
FIG. 2 is an enlarged perspective view of the can opening and liquid dispensing device free of attachment to said can.

The handle and spout part 14 of device 10 has several transverse indentations 22 on one side, and other indentations 24 on the opposite side, so that can be held with less danger of slippage than would otherwise be the case. The cutter 18 is sized to fit snugly, at one end, into the hollow interior of the handle and spout part 14 of the main body portion 12 of device 10, and it is secured to the handle and spout part with bolt fastening means 32 (see FIG. 1). Extending downwardly from said handle and spout part 14, as seen in FIG. 1, is a lip 34 sized to fit transversely across the space between the sides of the cutter at that point (where, as FIGS. 1 and 2 show, the cutter is of U-shaped cross-section to give it a curving bottom and pair of abrupt side walls). Cutter 18 has a pair of oppositely disposed, equally sized openings 20 therein which are provided to permit the drainage of oil from behind the cutter when the can opening and liquid dispensing device 10 is in use as described below.

Those parts and features of device 10 so far described (except for side arm 26 and punch member 28) are not new and have been incorporated in the conventional oil can spouts of commonly familiar type referred to above a great number of years. An oil can spout of this type (in which parts equivalent to those of device 10 will be hereinafter identified by the corresponding reference numerals of the latter), can be easily attached to an oil can for use by first bringing the lower portion of the guide 16 against the rim of the top of the upright can and placing the point 30 of cutter 18 on said top near said rim. It is then a simple matter to quickly thrust the cutter through the top of the can to form a pouring opening therein. The oil can spout is pushed down as far as it will go, at which point the lower edge of the downturned lip 34 bears against the metal can top at the base of a downwardly bent flap formed by the cutter. The can, with the oil can spout attached is then emptied by placing the outer end of the handle and spout part 14 in the oil filler opening of an internal combustion engine and either holding the can in position by hand or cocking the oil can spout in the oil filler opening to support the can while the oil drains slowly therefrom. The oil movement is slow because there is no air vent in the can, and there is little oil leakage at the junction of spout and can top. When the oil can spout is mounted on an oil can in the above-described fashion, it is held in place by friction with the side wall of the can sandwiched between the guide 16 and cutter 18 in the manner illustrated in FIG. 1 (which shows can opening and liquid dispensing device 10 attached to an oil 36, the manner of attachment being the same for that device as for said oil can spout).

My novel can opening and liquid dispensing means differs primarily from the conventional oil can spout described above in having unique manually controllable puncturing means that can be employed at the will of the user to provide an air vent hole in an oil can near the highest point in its wall after the can is placed in draining position over the oil filler opening of an engine. This puncturing means is generally illustrated at 38 on the drawing, and comprises the side arm 26 and punch member 28 referred to previously. Side arm 26 is formed from a suitable metallic strap, such as, for example, a mild steel or aluminum strap, and bent so as to have three sections, a short section 44, by means of which it is fastened to the handle and spout part 14 of the main body portion of device 10 with a couple of rivets 46, an intermediate section 48, and a third section 50. As will be clear from the drawing, the nature of the bends in side arm 26, and the manner and position in which the arm is fastened to the handle and spout part 14, are such that its intermediate section 48 extends diametrically away from handle and spout part 14 across the top of an oil can when device 10 is attached to the can for use, and then downwardly along the opposite side of the can generally parallel to the can's axis. Third section 50 of the side arm is twisted at 52 through 90° to permit proper pivotal attachment of the punch member 28 for use in the below-described fashion.

Figure 4:
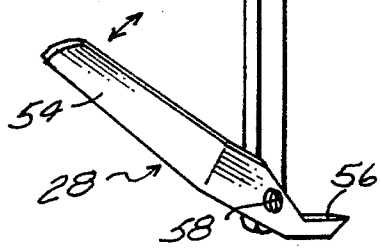
FIG. 4 is a fragmentary view of still another part of the device, as seen in the direction of the arrow 4 in FIG. 1.
Figure 4:
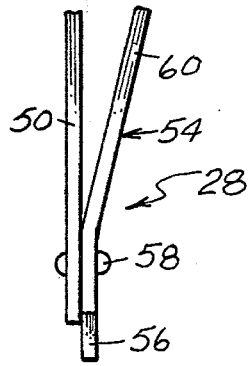

Punch member 28 is formed from strap metal, which can be the same as that from which side arm 26 is formed, and provided with a pointed claw 56 at its forward end and an elongate handle 54 for easy finger manipulation thereof. The punch member is pivotally fastened by means of a suitable pivot pin 58 to side arm 26 so that claw 56 can be brought into piercing contact with the can wall by swinging the handle 54 outwardly from the can wall through the arc indicated by the curved arrow in FIG. 1. As will be clear from the solid line position of the punch member in FIG. 1, that member is designed to ride harmlessly down along the side of the can wall with third section 50 of side arm 26 while can opening and liquid dispensing device 10 is being attached to a can of oil for use. When device 10 is fully mounted on the can the latter can be tilted for insertion of the forward end of its handle and spout part 14 into the oil filler opening of an engine similarly to the way the can with a conventional oil can spout of the commonly familiar type referred to above can be tilted. At this point, that portion of the side wall of the oil can adjacent the claw 56 of punch member 28 is near the highest part of the can and the punch member can be pivoted by its handle 54 into the phantom line position shown in FIG. 1 to punch an air vent hole in the can wall. Even if this punching step is done immediately upon positioning of the can for use over an oil filler opening, the resulting air vent hole will likely be above the oil level in the can. If it isn't, however, the opening of the vent hole has the effect of causing the oil to gush so rapidly out of the can that if any oil oozes out of the can through that hole it will be in such insignificant amount as to be negligible. As can be seen in FIG. 4, handle 54 of punch member 28 is bent so that a portion 60 thereof angles outwardly away from section 50 of side arm 26 to permit easy grasping and manipulation of the handle during usage of device 10.

In addition to including the puncturing means 38, can opening and liquid dispensing device 10 differs from the commonly familiar oil can spout referred to above in certain other respects. Thus, the device has a metallic tongue 64 fastened to the inner side of the downturned lip 34 of its handle and spout part 14 and extending below the lower edge of that lip, all as illustrated in the drawing. Tongue 64 serves to force downwardly into an oil can a metal flap cut by the shearing action of cutter 18 on the top of the can in forming a pour opening therein and thereby minimize the restrictive effect of that flap on the flow of oil therethrough, this function being illustrated in FIG. 1 where the tongue 64 is shown in downbearing contact with such a flap 70 in the top of oil can 36.

Figure 3:
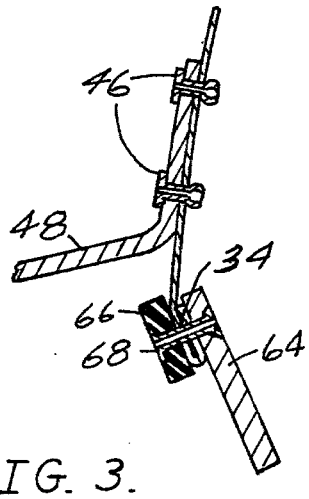
FIG. 3 is a still further enlarged, fragmentary, sectional view of part of the device, taken along line 3—3 of FIG. 2.

Fastened against the outer surface of downturned lip 34 is a rubber sealing strip 66. Rubber strip 66 is preferably made of an oil resistant rubber such as neoprene, and sized to extend transversely across the lip 34 and have a lower edge slightly below the lower edge of that lip so that it will bear against the top of an oil can adjacent the innermost edge of the opening formed in the can by cutter 18 when the can opening and liquid dispensing device is attached to such a can for use. The rubber strip thus serves as a seal to minimize the leakage of oil from the can as it is being drained into the oil filler of an engine. The tongue 64 and rubber seal 66 are fixedly secured in position either side of the downturned lip 34 by means of a rivet 68, as illustrated in FIG. 3. Those two parts are not critically necessary to functioning of my novel can opening and liquid dispensing device, but their presence is good insurance against the possibility of oil leakage during ordinary usage of the device and therefore highly desirable in view of the greatly increased rate of oil flow made possible by that device by comparison with the slow outflow of oil from a can fitted with an oil can spout of the commonly familiar type described above.

While my novel can opening and liquid dispensing means has been herein described and illustrated in what I consider to be a preferred embodiment, primarily suitable for use in the dispensing of motor oil from cans, those skilled in the art will appreciate that my invention is not limited to that particular embodiment and/or use, but is broad enough in concept to encompass all modifications thereof incorporative of the structural and functional essence of the invention as taught herein. Consequently, it should be understood that the present invention is intended to include within its scope all variant forms thereof encompassed by the language of the following claims.

I claim:

1. In can opening and liquid dispensing means of the type having a somewhat elongate cutter of U-shaped cross-section throughout much of its length adapted to cut an inwardly extending flap in one end of a sealed liquid containing can which has two ends and a cylindrical side wall, and thereby form a liquid dispensing opening in the can when forced through said one end, and a body comprising a pouring spout and guide, said cutter and said guide being relatively positioned to snugly receive said side wall whereby the guide keeps the cutter properly oriented to form said dispensing opening as said cutter is forced through said one end, said cutter having a pair of spaced apart cutting edges and a lip disposed transversely therebetween in position to permit it to bear against said one end of said can, along the base of said flap cut by the cutter in forming said liquid dispensing opening, after said opening has been formed by said cutter, said can opening and liquid dispensing means being usable in removable attachment to said can to permit the draining of said liquid therefrom through said liquid dispensing opening and said pouring spout, the improvement comprising:

bracket means adapted to extend from said pouring spout across said one end of said can, after said cutter has been forced therethrough to form said liquid dispensing opening therein, and then extend adjacent the cylindrical side wall of the can toward its opposite end; and manually operable punch means pivotally mounted on said bracket means in position, and adapted, upon finger manipulation thereof, to punch a hole through said side wall near said opposite end of said can, in the highest part of the side wall, when the can is properly tilted for pouring with said can opening and liquid dispensing means attached thereto for use;

whereby said hole can, at the user's option, be easily punched through said side wall to serve as an air vent hole to insure the rapid outflow of substantially all of the liquid from said can through said pouring spout.

2. An improvement in accordance with claim 1 in which said bracket means comprises an angled arm formed of suitably rigid material that extends diametrically across said one end of said can, after said cutter has been forced therethrough to form said liquid dispensing opening therein, then extends adjacent said side wall of said can generally parallel to the axis of the can.

3. An improvement in accordance with claim 2 in which said punch means comprises a rigid member pivotally mounted on said arm at a point of pivotal connection therewith, said member having a claw configuration at one end and being formed with an elongate handle by means of which it can be manually rotated about said point of pivotal connection to bring said claw configuration into puncturing contact with said side wall.

4. An improvement in accordance with claim 3 in which said angled arm is of strap metal configuration and has a substantially 90° twist in that part which is generally parallel to the axis of said can, said punch means is of strap metal configuration throughout most of its length, the movement of the punch means is scissors-like with respect to the angled arm about said point of pivotal connection therewith during manual rotation thereof for the purpose of punching said air vent hole in said side wall.

5. An improvement in accordance with claim 4 in which the elongate handle of said punch means is bent to angle outwardly away from said angled arm to permit convenient grip thereof for manual punching of said air vent hole in said side wall.

6. An improvement in accordance with claim 5 including a rigid tongue secured flush against the inner side of said lip and extending beyond the latter, said tongue being angled slightly outwardly from said cutting edges so as to bear against said flap cut by said cutter to help prevent obstruction of said liquid dispensing opening by the flap and thereby improve the flow rate of said liquid through the opening when said can opening and liquid dispensing means is attached to said can for use and liquid is being dispensed from the can through said pouring spout.

7. An improvement in accordance with claim 6 including a strip of resilient sealing material fixedly secured against the outer side of said lip, said strip having an edge disposed slightly beyond the edge of the lip to press against the top of said can and prevent excessive leakage around said liquid dispensing opening when said can opening and liquid dispensing means is attached to the can for use and liquid is being dispensed from the latter.

8. An improvement in accordance with claim 7 particularly adapted for use in dispensing motor oil from quart-sized cans of the oil.

9. An improvement in accordance with claim 8 in which said sealing strip is comprised of an oil resistant rubber.

* * * * *